US011672286B2

(12) United States Patent
Rybak

(10) Patent No.: US 11,672,286 B2
(45) Date of Patent: Jun. 13, 2023

(54) OUTERWEAR HAVING ENHANCED HOOD

(71) Applicant: Miroslav Rybak, Putnam Valley, NY (US)

(72) Inventor: Miroslav Rybak, Putnam Valley, NY (US)

( * ) Notice: Subject to any disclaimer, the term of this patent is extended or adjusted under 35 U.S.C. 154(b) by 0 days.

(21) Appl. No.: 16/924,484

(22) Filed: Jul. 9, 2020

(65) Prior Publication Data

US 2020/0404985 A1 Dec. 31, 2020

Related U.S. Application Data

(63) Continuation of application No. 15/843,386, filed on Dec. 15, 2017, now Pat. No. 10,743,593.

(60) Provisional application No. 62/442,275, filed on Jan. 4, 2017.

(51) Int. Cl.

| | |
|---|---|
| ***A41D 3/00*** | (2006.01) |
| ***A41D 27/04*** | (2006.01) |
| ***A41D 27/10*** | (2006.01) |
| ***A42B 1/048*** | (2021.01) |
| ***A41B 7/00*** | (2006.01) |

(52) U.S. Cl.

CPC ..... *A41D 3/00* (2013.01); *A41B 7/00* (2013.01); *A41D 27/04* (2013.01); *A41D 27/10* (2013.01); *A42B 1/048* (2013.01); *A41D 2200/20* (2013.01); *A41D 2300/33* (2013.01); *A41D 2400/44* (2013.01)

(58) Field of Classification Search

CPC ..... A41D 3/00; A41D 27/04; A41D 27/10; A41D 2200/20; A41D 2300/33; A41D 2400/44; A41D 3/02; A41D 3/04; A41D 27/02; A41B 7/00–7/12; A42B 1/048; A42B 1/04; A42B 1/045; A42B 1/046

USPC ..... 2/84, 202, 203, 204, 205

See application file for complete search history.

(56) References Cited

U.S. PATENT DOCUMENTS

| | | | | |
|---|---|---|---|---|
| 5,208,919 | A * | 5/1993 | Fields | A41D 27/10 2/123 |
| 5,504,944 | A * | 4/1996 | Bromer | A41B 7/00 2/93 |
| 6,748,632 | B2 * | 6/2004 | Nakai | A41D 5/00 28/100 |
| 7,849,522 | B2 * | 12/2010 | Roux | A41D 1/08 2/227 |
| 2013/0097763 | A1 * | 4/2013 | Lewis | A41D 3/00 2/69 |
| 2016/0366953 | A1 * | 12/2016 | Watts | A41D 13/0058 |

* cited by examiner

*Primary Examiner* — F Griffin Hall

(74) *Attorney, Agent, or Firm* — Mestechkin Law Group P.C.

(57) ABSTRACT

The present application provides a garment that includes: a sleeve, a cuff, a retainer, and a sleeve lining attached at one end thereof at a proximal end of the sleeve, the sleeve lining extendible outward sufficient to cover at least a portion of a wearer's hand and retractable inward at a distal end of the sleeve; the retainer having a first end attached at the distal end of the sleeve to the sleeve and the sleeve lining, wherein the retainer is configured to limit at least the retractable inward movement of the sleeve lining; the cuff is located at the distal end of the sleeve lining and comprises a padding removably coupled to the cuff at a location proximate to the wearer's palm.

11 Claims, 7 Drawing Sheets

OUTERWEAR HAVING ENHANCED HOOD

CROSS-REFERENCE TO RELATED APPLICATIONS

This patent application is a continuation of U.S. patent application Ser. No. 15/843,386, filed Dec. 15, 2017, entitled "OUTERWEAR HAVING ENHANCED HOOD," which application claims priority to U.S. Provisional Patent Application No. 62/442,275, filed on Jan. 4, 2017, entitled "OUTERWEAR HAVING ENHANCED HOOD," the disclosures of which are incorporated by reference herein in their entirety.

BACKGROUND

This patent application relates to clothing and more particularly outdoor garments.

While jackets having hoods of various configurations and methods of use are well known, existing methods of controlling the positioning of a hood and other appendages extending from the main body of the garment requires either the use of both wearer's hands or the use of a single hand but in a complicated manner. There remains a need for alternative mechanisms of controlling a hood or other appendage of a garment with greater simplicity and convenience to the wearer.

SUMMARY OF THE INVENTION

The present application provides a garment that includes: a hood, the hood having an opening at a front of the hood, the opening extending between a bottom and top of the hood; at least a first passageway meandering in a concave shape on at least one side of the hood and extending from the bottom front of the hood, rearward over a wearer's shoulder, transitioning vertically toward the top of the hood, and continuing at the top of the hood forward back over the wearer's shoulder toward the front of the hood; and at least one drawstring disposed within the first passageway.

In one embodiment, the garment includes a plurality of passageways, each located on a side of the hood.

In one embodiment, a second of the plurality of passageways has a curvature that mirrors the first passageway.

In one embodiment, the second of the plurality of passageways is located on another side of the hood and wherein pulling the drawstring causes the sides of the hood to contract in a vertical and horizontal direction.

In one embodiment, each of the first and second passageways terminate at a brim at the front of the hood.

In one embodiment, the drawstring is detachably connected at one end to the brim of the hood.

In one embodiment, the plurality of passageways intersect to form a continuous passageway.

In one embodiment, the plurality of passageways intersect at a brim at the front of the hood.

In one embodiment, pulling the drawstring causes the at least one side of the hood to contract in a vertical and horizontal direction.

In one embodiment, the garment includes a sleeve and a sleeve lining attached at one end thereof at a proximal end of the sleeve, the sleeve lining extendible outward sufficient to cover at least a portion of a wearer's hand and retractable inward at a distal end of the sleeve.

In one embodiment, the garment includes a retainer having a first end attached at the distal end of the sleeve to the sleeve and sleeve lining, the retainer limiting at least the retractable inward movement of the sleeve lining.

In one embodiment, the garment includes a cuff at the distal end of the sleeve lining.

In one embodiment, the cuff comprising padding at a location about the wearer's palm.

In one embodiment, the padding is removably coupled to the cuff.

In another aspect, a garment is provided that includes: a hood, the hood having an opening at a front of the hood, the opening extending between a bottom and top of the hood; at least first and second passageways each meandering in a concave shape on at least one side of the hood and extending from the bottom front of the hood, rearward over a wearer's shoulder, transitioning vertically toward the top of the hood, and continuing at the top of the hood forward back over the wearer's shoulder toward the front of the hood; and at least way drawstring disposed within the first and second passageway.

In another aspect, a garment is provided that includes: a hood, the hood having an opening at a front of the hood, the opening extending between a bottom and top of the hood; at least first and second passageways each meandering on at least one side of the hood; and at least way drawstring disposed within the first and second passageways, the first and second passageways meandering such that pulling the drawstring causes the sides of the hood to contract in a vertical and horizontal direction.

DETAILED DESCRIPTION

The present application relates to garments with one or more appendages, such as a hood, sleeve, etc. Although the description herein may refer to a jacket by way of example, it is understood that the inventive concepts discussed herein are not limited only to jackets.

Figure 1:
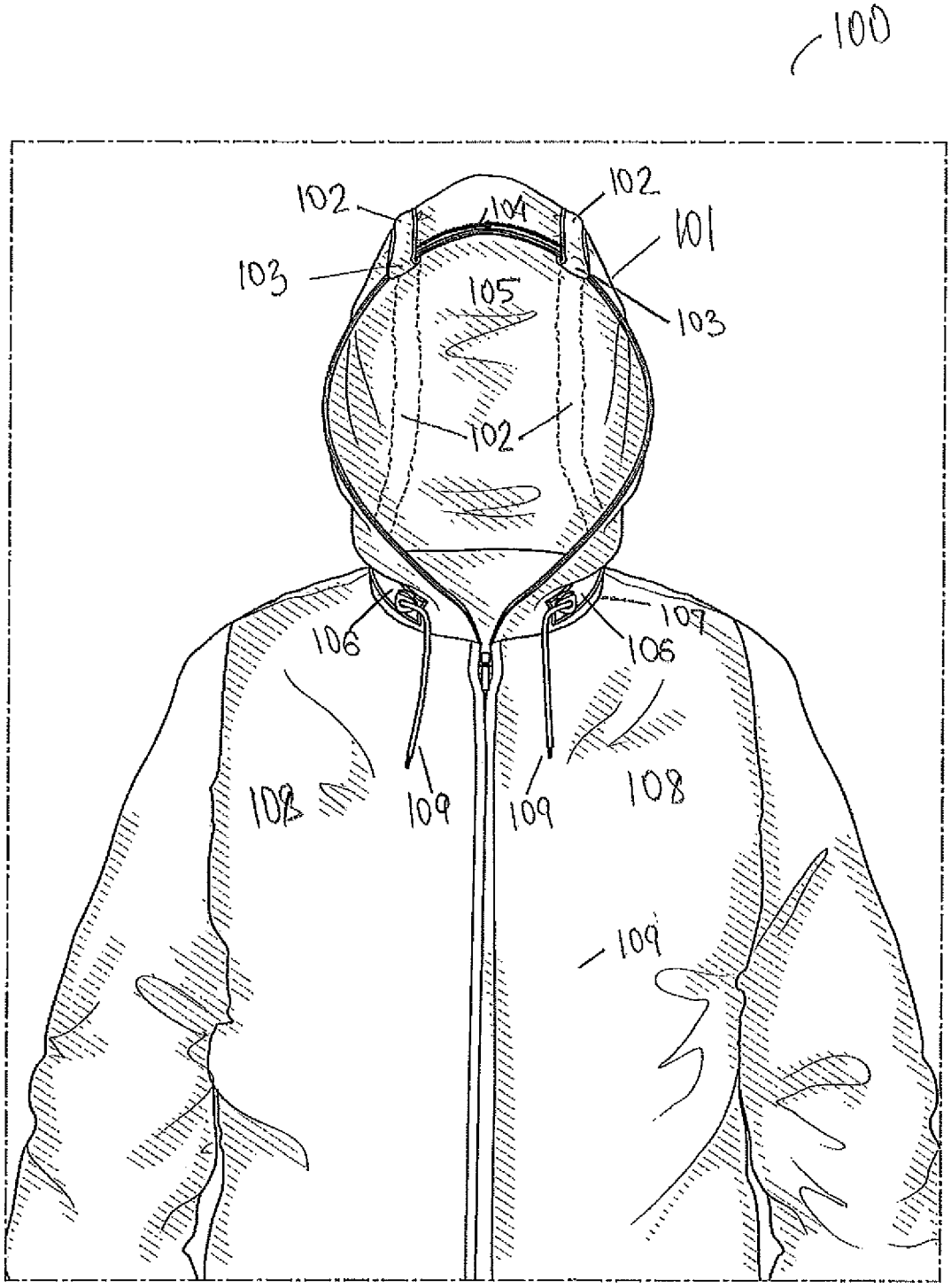
FIG. 1 presents a front view of an outerwear garment (e.g., jacket) according to at least one embodiment showing a hood thereof in its raised position.

FIG. 1 illustrates a front view of an outerwear jacket, e.g., a jacket 100 presenting a hood 101 in its raised (i.e., deployed) position and featuring drawstring passageways 102 represented in solid and dashed lines. In the preferred embodiment, each drawstring passageway 102 is shown to terminate on one end 103 at an upper edge of the brim 104 of the face opening 105 of hood 101 and terminate on one other end 106 in the front of the jacket 100, proximate to the junction of attachment of a hood base 107 and a torso portion 108 of jacket 100. The passageways 102 generally meander between ends 103 and 106 to form a concave shaped passage (when viewed from the side of the hood) with an opening facing the same direction as the opening in the hood 105. More specifically, the passages 102 begin at the at the front of the garment near the base 107, continue rearward over the wearer's shoulder, transitioning vertically toward the top of the hood 111, and at the top continuing forward back over the shoulder to the front of the hood at end 103.

This configuration of drawstring passageways 102 enables a wearer to remove (pull back) the hood 101 from the wearer's head by merely pulling on both free ends of the drawstrings 109. This pulling of the drawstring causes the hood to contract and thus tighten in both the vertical and horizontal directions, unlike traditional hoods that contract vertically only at the front of the hood causing the opening thereof to close thereby potentially obstructing the wearer's view. It is to be understood that the drawstrings 109 may be deployed within the drawstring passageways 102 in such ways as to enable complete detachment and extraction of drawstrings 109 from the drawstring passageways 102. For example, one free end of each of the drawstrings 109 can be attached to the upper edge of the brim 104 with a clip, button, removable fastener, and the like. Positioning of the one other end 106 of drawstring passageways 102 ensures that drawstrings 109, when secured (e.g., knotted, etc.) together to secure the upper portion of brim 104 of the face opening of the wearer (i.e., at the top of wearer's head), are not coming in contact with the chin of the wearer, thereby eliminating discomfort of the wearer and obstruction of view. While FIG. 1 illustrates only drawstring passageways 102, a person skilled in the art would understand that additional drawstring passageways (not shown) may be included in other parts of the assembly of the hood 101 to add additional functionalities to the hood 101.

Figure 2:
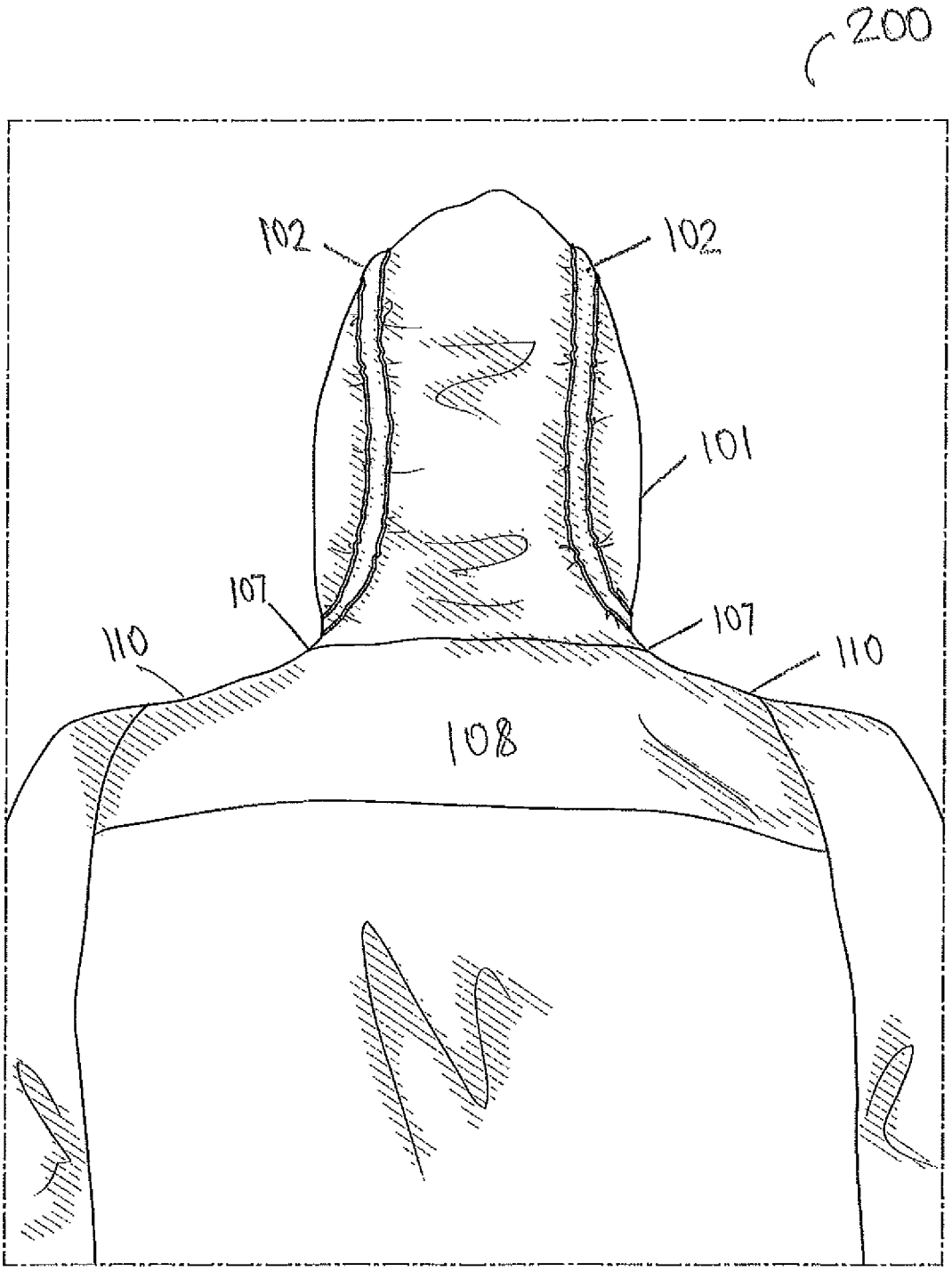
FIG. 2 presents a rear view of the jacket showing a hood in its raised position.

FIG. 2 illustrates a rear view of jacket 200 showing hood 101 in its raised (i.e., deployed) position and showing the drawstring passageways 102 extending over the top of the hood 101 (front to back), down along the back of the hood 101, and curving back over the shoulders 110 in a forward direction toward the front chest panel of j acket 200 along and in close proximity to the junction of attachment of hood base 107 and the torso portion 108 of j acket 200. It is to be understood that configuration of the drawstring passageways 102 is constructed in such a way as to eliminate or mitigate a pressure of the drawstrings 109 under tension (when pulled by a wearer) on a head or a neck of the wearer.

Figure 3:
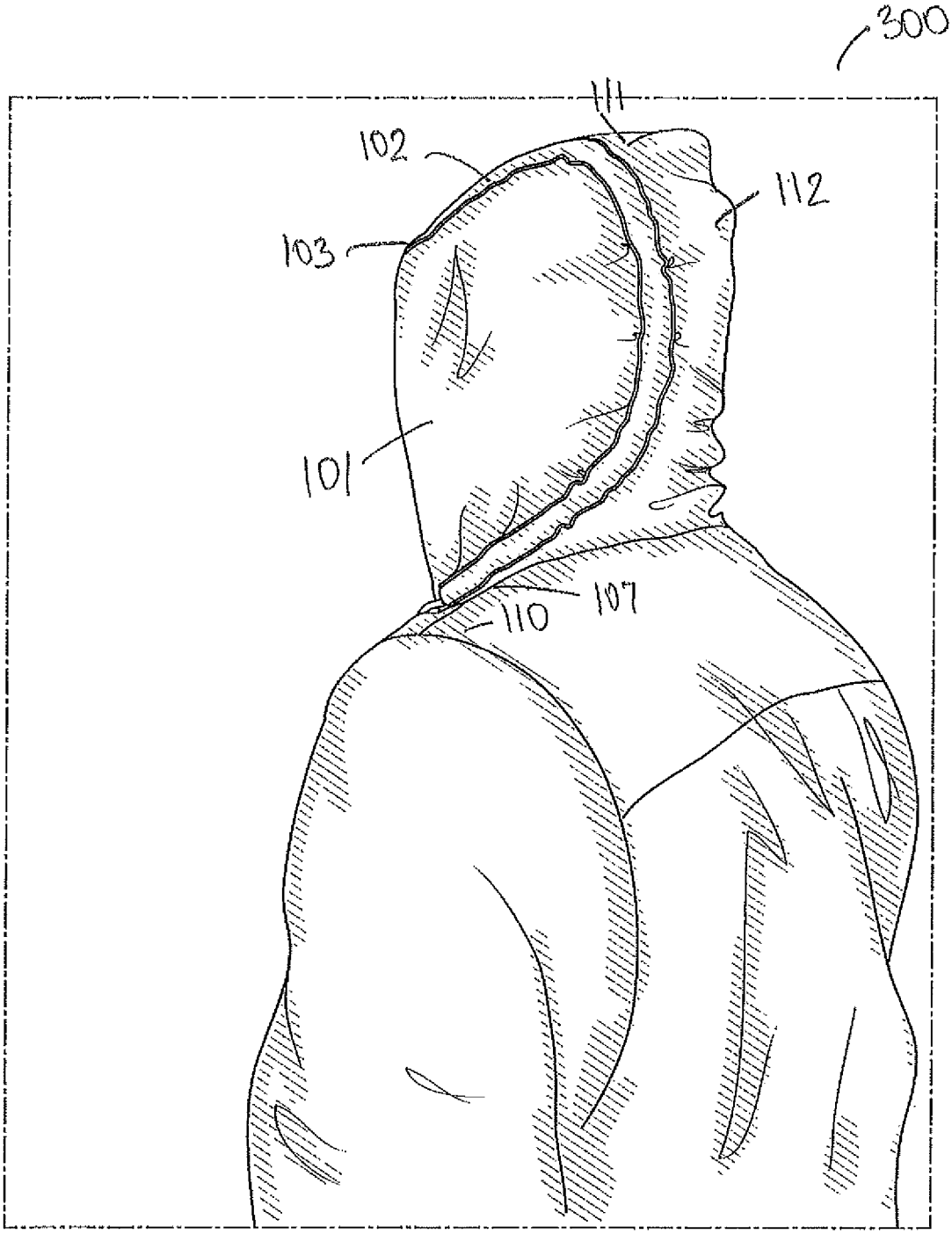
FIG. 3 presents a prospective raised rear left side view of a jacket showing a hood in its raised position.

FIG. 3 illustrates a prospective raised left side view of jacket 300 showing hood 101 in its raised (i.e., deployed) position and showing drawstring passageway 102 on the left side of hood 101, the drawstring passageway 102 terminating on one end 103 at the brim's right upper edge of the face opening of hood 101, extending rearward over the top 111 of the hood 101, down along the rear side 112 of the hood 101, and then curving back over the left shoulder 110 toward the front portion of torso portion of jacket 300 along and in close proximity to the junction of attachment of hood base 107 and the torso portion 108 of jacket 300. It is to be understood that configuration of the drawstring passageways 102 is constructed in such a way as to eliminate or mitigate a pressure of the drawstrings 109 under tension (when pulled by a wearer) on a head or a neck of the wearer.

Figure 4:
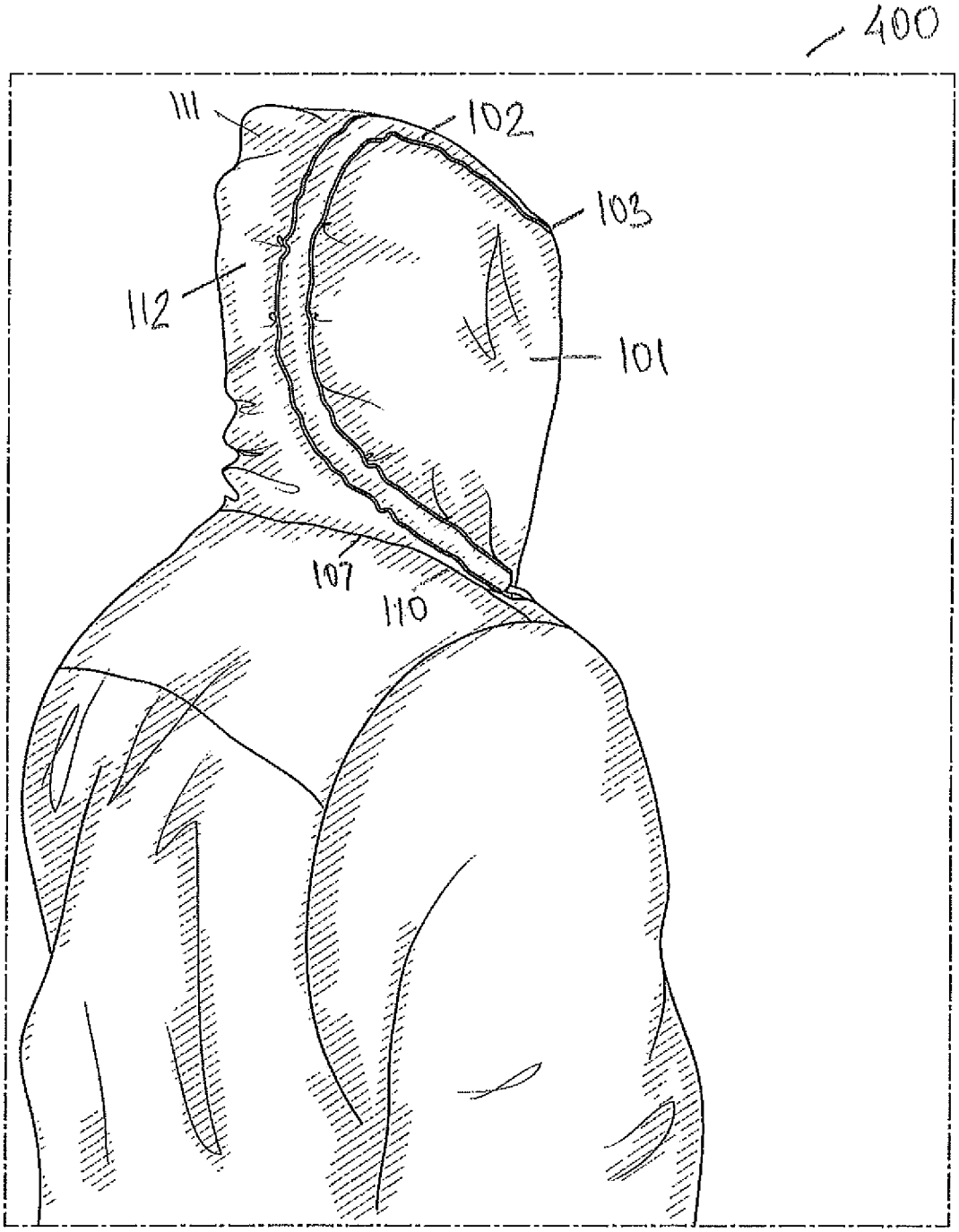
FIG. 4 presents a prospective raised rear, right-side view of a jacket showing a hood in its raised position.

FIG. 4 illustrates a mirror image of what is depicted in FIG. 3, illustrating the prospective raised right-side view of the jacket 400.

Figure 5:
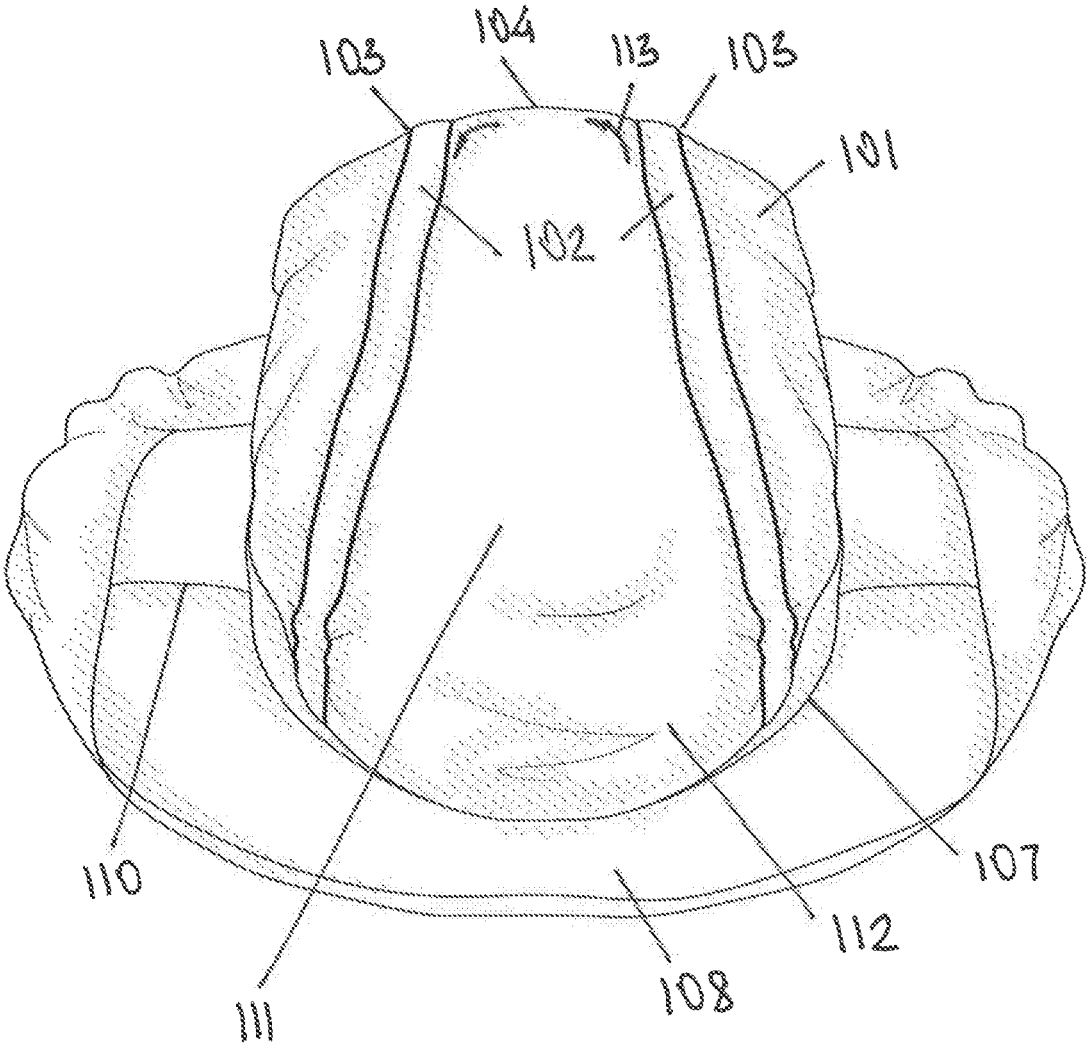
FIG. 5 presents a top view of the jacket showing a hood in its raised position.

FIG. 5 illustrates a top view of jacket 500, illustrating hood 101 having, in one embodiment, drawstring passageways 102 terminating on one end 103 at the brim's upper edge 104 of the face opening of hood 101 and extend over the top 111 of the hood 101, down to the back 112 of hood 101. In an alternative embodiment, drawstring passageways 102 do not terminate at one end 103 but form a continuous passageway along the brim's upper edge 104, illustrated by an arrow 113. In this case, there is a single drawstring extending through the passageway 102 and having two ends 106.

Figure 6:
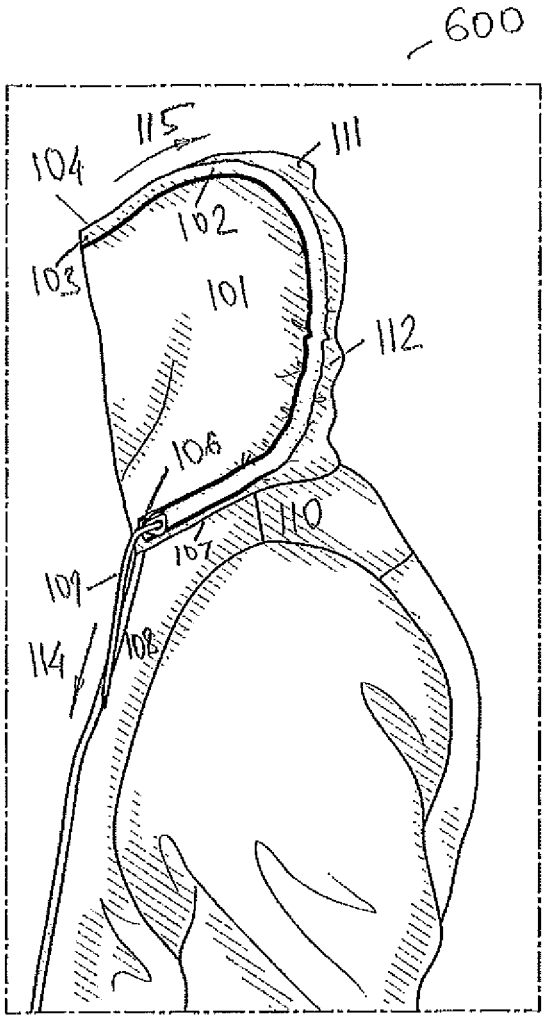
FIG. 6 presents a left-side view of the jacket showing a hood in its raised position.

FIG. 6 illustrates a left side view of jacket 600 presenting hood 101 in its raised position and showing drawstring passageway 102 on the left side of hood 101, the drawstring passageway 102 shown as extending rearward from the front 103, over the top portion 111 of the hood 101, then down toward the rear portion 112 of hood 101 and then curving back over the left shoulder 110 toward the front side of the torso portion 108 of jacket 600 along and in close proximity to the junction of attachment of hood base 107 and the front side of torso portion 108 of jacket 600.

Figure 7:
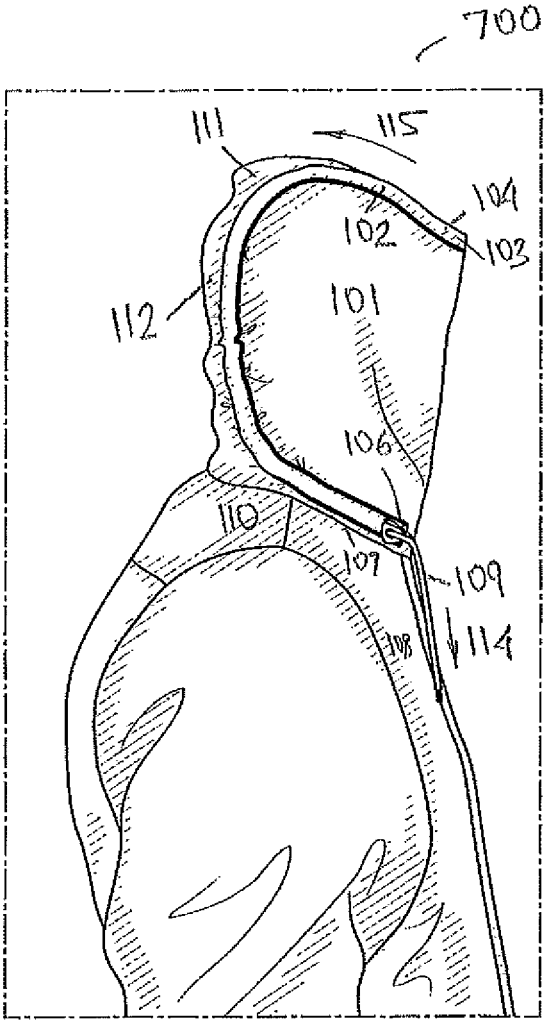
FIG. 7 presents a right-side view of the jacket showing a hood in its raised position.

FIG. 7 illustrates a right side view of jacket 700 presenting hood 101 in its raised position and showing drawstring passageway 102 on the right side of hood 101, the drawstring passageway 102 shown as extending over the top portion 111 of the hood 101, down to the rear portion 112 of hood 101 and curving back over the right shoulder 110 toward the front side of the torso portion 108 of jacket 600 along and in close proximity to the junction of attachment of hood base 107 and the front side of torso portion 108 of jacket 700.

As noted above, in an alternative embodiment, hood 101 is constructed to include a single drawstring passageway 102 originating at one end 106, extending along the upper edge of brim 104 of hood 101, and terminating at one other end 106 (best illustrated in FIG. 5). A person skilled in the art would understand that the single drawstring passageway 102 repeats a combined configuration of drawstring passageways 102, as shown in FIGS. 1-7.

The novel positioning of drawstring passageways 102 provides for tightening of the upper edge of brim 104 around the wearer's head at the forehead area such that in the tightened position hood 101 is not affected by, for example, strong wind and does not obstruct view or breathing passages of a wearer as conventional hoods tend to do. Also, a novel placement of drawstring passages 102 enables the wearer to remove hood 101 from the wearer's head using both hands by pulling drawstrings 109 downward, as shown by arrow 114 in FIGS. 6-7, causing the hood slide off the wearer's head towards the back portion of j acket and affixed in a certain position by a plastic stopper attached in such a way as to be moved up and down drawstrings 109 to be positioned as necessary at the convenience of the wearer, as illustrated by arrow 115 in FIGS. 6-7.

When drawstrings 109 are pulled to the extent that hood 101 is pulled fully off the wearer's head, the configuration of the drawstring passages 102 causes hood 101 to be folded compactly on the wearer's neck to form a cushion around the rear portion of the wearer's neck. Such cushion serves as a layer protecting the wearer from a harsh weather condition. Also, for those who wear an outerwear having the enhanced hood disclosed herein to ride a motorcycle, the cushion formed by hood 101, in its fully lowered position, servers as a cushioning layer on which the rear bottom portion of the motorcycle helmet may rest, thereby relieving a stress on the neck of the wearer from wearing a heavy motorcycle helmet.

In a preferred embodiment, the configuration of the drawstrings passageways is as such that, when drawstrings 109 are pulled to the extent that hood 101 is pulled fully off the wearer's head, the configuration of the drawstring passages 102 causes hood 101 to be folded compactly to be in close and tight contact with the lower portion of the hood to minimize entry of airstream inside the hood when a wearer of the jacket rides a motorcycle, thereby precluding or minimizing any "parachuting" effect of the hood.

In various aspects of the invention, drawstrings 109 may be elasticated cords, and the drawstrings may run in passageways 102 formed in the hood material, formed for example by adhesive application of channel strips to the interior of the hood, or by sewn channels or guides applied to the inside of hood 101.

Figures 8, 9:
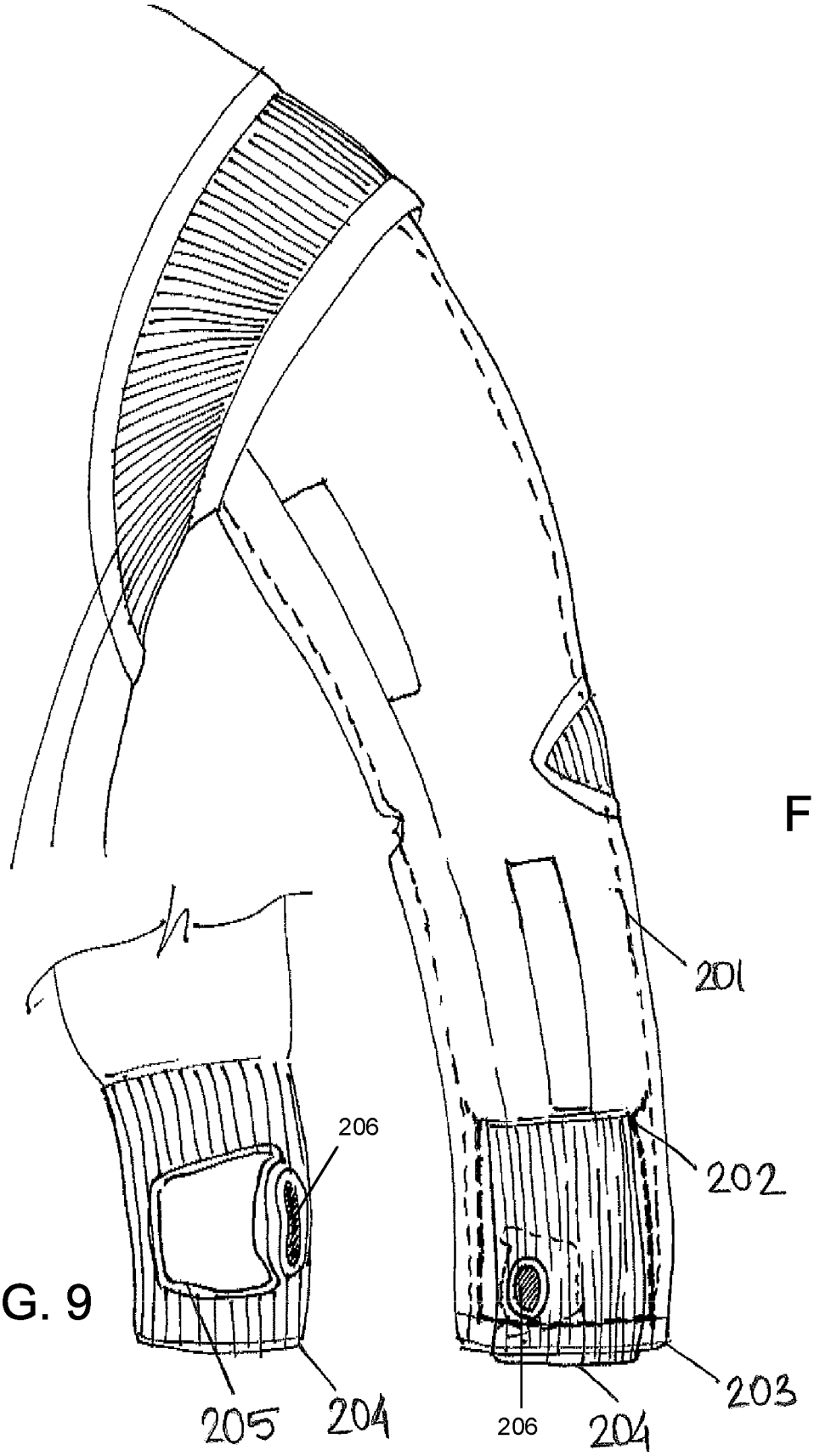
FIG. 8 presents a rear view of an appendage of a garment (e.g., sleeve of a jacket) according to at least one embodiment.
FIG. 9 presents a rear view of a lining of the sleeve according to at least one embodiment.

FIG. 8 presents a rear view of an appendage of a garment (e.g., sleeve of a jacket) according to at least one embodiment, which includes a sleeve 203. The sleeve 203 includes a sleeve lining 201. The sleeve lining is preferably made out of or includes a stretchy material and is attached at the shoulder of the jacket at a proximal end and to the cuff 204 at the distal end. The length of the lining 201 and cuff 204 combination is preferably about the length of the sleeve 203. The stretchy material in this configuration allows the user to extend the cuff 204 outward from the distal end of the sleeve 203 (causing the stretchy material to expand) when worn and the cuff 204 retracts back into the sleeve 203 when the cuff 204 is not utilized. That is, the cuff 204 is used by securing it to the user's hand, for example, by inserting the user's thumb into opening 206. When not in use, the cuff 204 remains retracted within the sleeve 203. The garment may also include a retainer 202, which is attached at the distal end of the sleeve 203 and at the proximal end of the cuff 204. The retainer 202 is preferably made from thin lining type of a material and is so configured to prevent the sleeve lining 202 and cuff 204 from being dragged out from the sleeve 203 when the user's arm is removed from the sleeve 203. The cuff 204 is preferably made from rib knit and possesses elastic quality. The length of the cuff 204 (front to back) allows the user to wear it comfortably as a glove substitute, e.g., it covers most or all of the average user's hand. When not utilized as a glove substitute, it seals the sleeve 203 at the distal end to keep the user warm.

FIG. 9 presents a rear view of a lining of the sleeve according to at least one embodiment, which includes a padding 205 located on the rear of the cuff 204. The padding 205 is preferably to be over the user's wrist and/or within the palm of the user's hand when in use. The padding 205 may include a gel insert made from "Impact Gel" with shock absorption technology. The location of the gel insert provides improved comfort and vibration\shock absorption for when the user is riding a motorcycle or holding a ski pole, etc. The gel insert may be fixed to the cuff or removably placed into a pre-made pocket within the cuff 204.

It is to be understood that the disclosed jacket may include various existing and novel configurations and designs attributed to outerwear. Jackets may be made out of a wide range of materials, such as natural fibers and/or synthetic materials. In some embodiments, the jacket may be made of a waterproof breathable laminate such as expanded porous polytetrafluoroethylene coated with a breathable fabric, as is well known in the art of technical outdoor garments.

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way. Numeric ranges are inclusive of the numbers defining the range.

In the specification, the word "comprising" is used as an open-ended term, substantially equivalent to the phrase "including, but not limited to", and the word "comprises" has a corresponding meaning. Citation of references herein shall not be construed as an admission that such references are prior art to the present invention.

All publications, including but not limited to patents and patent applications, cited in this specification are incorporated herein by reference as if each individual publication were specifically and individually indicated to be incorporated by reference herein and as though fully set forth herein. The invention includes all embodiments and variations substantially as hereinbefore described and with reference to the examples and drawings.

What is claimed is:

1. A garment comprising:

a sleeve having a proximal end and a distal end, the sleeve having an opening at the distal end thereof, the opening of the sleeve having a perimeter, and a sleeve lining contained within the sleeve, the sleeve lining having a proximal end and a distal end, the sleeve lining having an opening at the distal thereof, the opening of the sleeve lining having a perimeter, the perimeter of the sleeve lining opening being entirely separate from the perimeter of the sleeve opening, the sleeve lining comprising a stretchy material sufficiently elastic for the perimeter of the opening in the sleeve lining to be extendible entirely outward through and beyond the sleeve opening perimeter at the distal end of the sleeve, for the sleeve lining to extend sufficient far distally to circumferentially cover at least a portion of a wearer's hand, and the perimeter of the opening in the sleeve lining retractable inward though the opening at the distal end of the sleeve automatically when the sleeve is not in use, wherein the sleeve lining is stitched directly to the sleeve at the proximal end of the sleeve.

2. The garment of claim 1, further comprising: a retainer having a first end attached to the sleeve at the distal end of the sleeve and to the sleeve lining, wherein the retainer is configured to limit at least the retractable inward movement of the sleeve lining.

3. The garment of claim 1, further comprising an elastic knit cuff at the distal end of the sleeve lining.

4. The garment of claim 3, wherein the cuff comprises a padding configured to be disposed at a location proximate to the wearer's palm.

5. The garment of claim 4, wherein the padding is removably coupled to the cuff.

6. The garment of claim 3, wherein the sleeve lining comprises a stretchy material sufficiently elastic for the cuff to extent outward from the distal end of the sleeve and to retract automatically inward into the sleeve when the cuff is not utilized.

7. The garment of claim 3, wherein a combined length of the sleeve lining and the cuff equates approximately to a length of the sleeve.

8. The garment of claim 3, further comprising: a retainer having a first end attached to the sleeve at the distal end of the sleeve and to the cuff, wherein the retainer is configured to limit at least the retractable inward movement of the sleeve lining.

9. The garment of claim 3, wherein the cuff has an opening therein configured on the cuff for the wearer to insert a thumb into the opening.

10. The garment of claim 1, wherein the garment is a jacket and wherein the sleeve lining is stitched to the sleeve at an arm hole of the jacket.

11. The garment of claim 10, wherein the jacket comprises a second sleeve having a sleeve liner contained therein.

* * * * *